United States Patent [19]

Wiseman

[11] 4,103,785

[45] Aug. 1, 1978

[54] APPARATUS FOR ROTATING AND DISCHARGING ARTICLES

[76] Inventor: Raymond L. Wiseman, 1550 S. Macon St., Aurora, Colo. 80012

[21] Appl. No.: 715,430

[22] Filed: Aug. 18, 1976

[51] Int. Cl.[2] ..... B65G 57/16

[52] U.S. Cl. ..... 214/6.5; 198/374

[58] Field of Search ..... 214/6 P, 6 D, 6.5, 152; 198/344, 374, 379, 414, 412; 93/93 DP; 104/35, 36, 37

[56] References Cited

U.S. PATENT DOCUMENTS

| | | | |
|---|---|---|---|
| 1,880,077 | 9/1932 | Dill et al. | 214/6.5 |
| 3,100,039 | 8/1963 | Oderman et al. | 198/414 |
| 3,269,565 | 8/1966 | Kemp | 214/6 P X |
| 3,532,230 | 10/1970 | Gutberlet et al. | 214/6.5 X |
| 3,595,370 | 7/1971 | Fujishiro | 214/6.5 X |
| 3,599,807 | 8/1971 | Hedrick et al. | 214/6.5 |

FOREIGN PATENT DOCUMENTS

| | | | |
|---|---|---|---|
| 1,396,545 | 6/1975 | United Kingdom | 198/414 |

*Primary Examiner*—Drayton E. Hoffman
*Assistant Examiner*—Ross Weaver
*Attorney, Agent, or Firm*—Fay & Sharpe

[57] ABSTRACT

An improved apparatus for rotating and discharging articles such as stacks of newspapers combines a turntable and discharge elements in a sub-assembly that rotates as a unit relative to the frame. Rotation of the turntable and motion of the discharge elements are coordinated but not made synchronous.

26 Claims, 6 Drawing Figures

APPARATUS FOR ROTATING AND DISCHARGING ARTICLES

This invention relates to improvements in means for rotating and discharging articles such, for example, as stacks of newspapers.

BACKGROUND OF THE INVENTION

The movement of finished printed articles from printing press to the shipping platform has long been one of the more difficult tasks in the publications industry. While the problem is experienced in the publications industry generally, it is most severe in newspaper production where the product, the finished newspaper, varies in size and weight from day to day, and, because of being folded along two adjacent sides and cut edges at its other sides, has greater thickness at the folded edges and has a top or bottom surface that is curved. As a consequence of their shape, it is difficult to form stacks of newspapers and to move those stacks at high speeds.

No better system has been devised than to receive newspapers from the press where they are printed, assembled, and folded, and then to stack a number of those newspapers flat, one atop the other, so that they can be tied, stored and distributed as bundled stacks of papers. In an effort to deliver newspapers whose news is as current as possible, the production of the newspaper is completed at the last possible time that permits the distribution system to perform its task. The presses can produce newspapers at rates in excess of twenty papers per second. The rate from the presses is so great that the steps of stacking and tying cannot be accomplished at the same work position. Instead, the tasks must be separated. The stack is formed at one position and is immediately conveyed away to another work station at which the stack is tied into a bundle. The task of tying the bundle, and the task of conveying the stack from the stacker to the bundler is greatly facilitated if half of the papers in a stack are rotated by 180° relative to the remainder of the papers in the stack so that the folded edge of half of the papers overlies the cut edges of the other half of the papers. The need for such rotation increases as the thickness of the papers, and thus the height of the stack, is increased. The non-uniform shape that makes rotation necessary prevents rotation of half of a completed stack. Thus it is that the rotation must be accomplished during formation of the stack. In practice, papers are delivered to the stacking position, all oriented in the same fashion. Usually, they are delivered with the folded edge forward. When the papers have been stacked to half of the finished stack height, the half stack is rotated by 180° and the upper half of the stack is placed on top of that rotated lower half.

Newspapers are produced and conveyed to the stacking position in a substantially continuous stream. However, at the stacker, the process becomes intermittant. The papers are placed on a platform which must remain stationary over the period in which the stack is formed, or over part of that period in the case in which part of the stack is rotated. As a consequence, stack rotation and discharge of completed stacks from the stacking position must be accomplished very rapidly. Because of their shape, the center of gravity of the stack of papers seldom falls on the rotational axis of the stacking. Further, the individual papers of a stack cannot be made to lie with their individual centers of gravity in a single line. As a consequence of that, rapid rotation of a stack gives rise to forces that tend to separate the papers and to disintegrate the stack. That is prevented by the use of retaining structures at all four sides of the stack to restrain it against disintegration. That restraining structure, at least at one side of the stack, must be removed before the stack can be discharged from the stacking position to make room for the next stack. The timing is such that discharge almost always must be accomplished positively by pushing the completed stack out of the stacking position.

The stacking table and the mechanism that rotates it, and the restraining structures, and the mechanism that removes those structures and the elements that push the papers out of the stacking zone, and the mechanism that operates that structure must all be designed to have sufficient strength to withstand the forces generated in accelerating and decelerating the newspaper stack, and, in their own acceleration and deceleration. Large forces are generated requiring the use of heavy drive mechanisms. That requirement further compounds the problem.

Thus it is that the transition from the more or less continuous process production of newspaper to intermittant processing at the stacker gives rise to some difficult problems. Stack rotation and discharge occur at different times, and, since the size of newspapers changes from day to day, it is not possible to link together the rotation and discharge mechanisms to produce a fixed, synchronous operation. Moreover, the flow of papers to the stacker frequently becomes non-uniform. Individual papers may become misaligned and become lodged to jam the operating mechanism unless that mechanism is arranged so that some variation in the time sequence of mechanism operation is possible. The problem that is faced by the designer of a stacker mechanism is how to divide a structure in which stacked rotation and discharge can be accomplished by separate mechanisms capable of rapid acceleration and deceleration to provide coordinated but non-synchronous function.

SUMMARY OF THE INVENTION

It is an object of this invention to provide an improved method and means for rotating and discharging articles, especially stacked articles. It is an object to provide a structure which can rotate and discharge stacks of articles at rates as high or higher than have been possible in previous apparatus, and to accomplish that result with a less complicated and lighterweight apparatus than has been possible in the past.

It is an object of this invention to provide an apparatus which can rotate and discharge stacks at a rate equal to, or greater than, the rate of operation of previous apparatus and to accomplish that with lower mechanism velocities than has been possible in the past.

The effect of lower velocities in operating the mechanism is to diminish acceleration and deceleration rates whereby to reduce the danger to the people who operate those mechanisms and with less liklihood of damage to those mechanisms in the event that articles being processed become caught or jammed.

Thus it is that the invention has as its object to provide a mechanism that operates better, and more safely, and more reliably, than does the prior art apparatus. Not only does the invention achieve those results, but it makes possible reduction in initial production costs and maintenance costs as well.

These several objects and advantages of the invention, and others that will appear in what follows, are realized in part by incorporating the discharge mechanism in the stack rotation mechanism. Whereas it might be expected that the combination of those structures would result in increased mass and higher inertial forces, what actually happens is that the discharge mechanism can be made more compact and the moment of inertia held to a minimum to the end that the total amount of inertial force that must be dealt with in performing the rotation and discharge task is less than what is presented by prior art mechanisms of the same capacity. By incorporating the discharge mechanism in the stack rotation mechanism, the discharge structure becomes available to aid in restraining the stack against disintegration during rotation. Further, to incorporate the discharge mechanism in the rotation unit simplifies the structure to the end that the rotation apparatus can be simplified.

A further effect of mounting the discharge mechanism on the stack rotation mechanism is to simplify the problem of coordinating motions of the several mechanisms. That simplifies the incorporation of safety features, and to do that is another object of the invention.

DESCRIPTION OF THE PREFERRED EMBODIMENT

Figure 1:
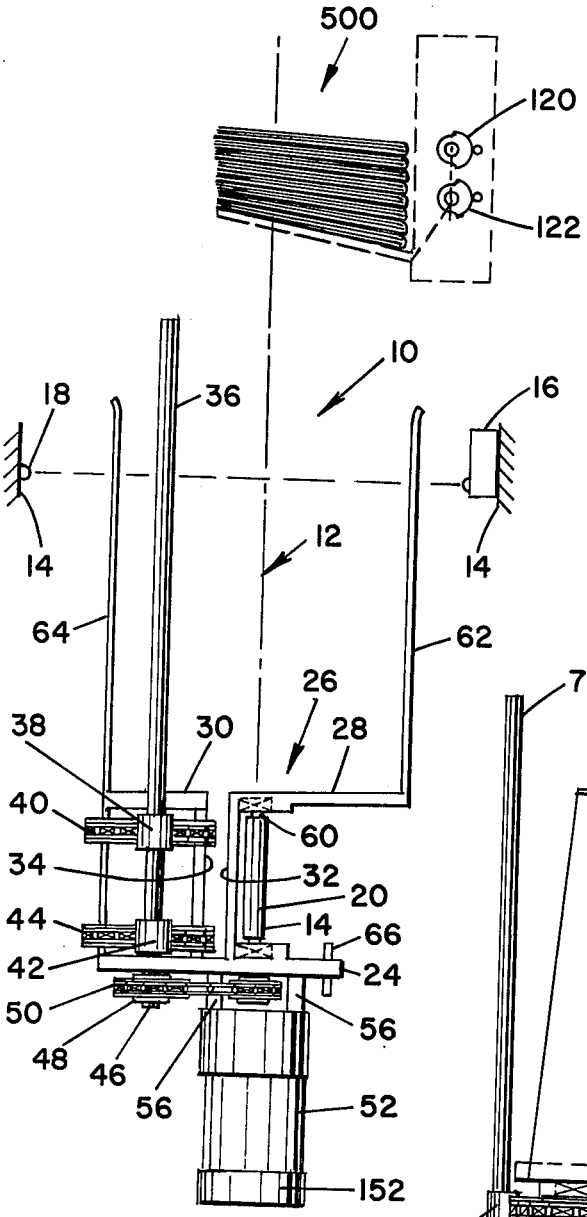
FIG. 1 is a drawing of an apparatus for rotating and discharging articles, according to the invention, together with structures for delivering newspapers to that apparatus, parts of which are shown schematically.

The invention is not limited to the stacking and rotation and discharge of newspapers. It can be used in connection with the production and handling of other kinds of printed products, and, in fact, of a very wide variety of discreet articles. However, the stacking of newspapers is a particularly difficult task. The invention is well suited to that task and it is for that reason that a newspaper stacking turntable and discharge unit has been selected for illustration in the drawings. It represents the currently preferred embodiment.

In FIG. 1, the article rotating the discharge unit is generally designated by the reference numeral 10. It is mounted on a frame and is rotatable relative to the frame on an axis 12, which in most cases would be arranged to extend vertically. Most of the frame has been omitted for the sake of clarity. A few parts of the frame have been shown to indicate which portions of the apparatus are fixed relative to one another. Those frame elements are designated with the reference numeral 14. That numeral appears three times in FIG. 1. It indicates that the light sensor 16 and the light source 18 are both fixed to the frame. It indicates, also, that the arm 20 is a part of the frame, and it is on the arm 20 that the turntable and the discharge elements and the drive means for driving the discharge elements are all mounted.

The rotating and discharge assembly comprises a sub-frame the shape of which is relatively complex. It comprises a lower plate 24, and an upper turntable or platform, generally designated 26 which is divided into two sections. One of those sections is designated 28 and the other is designated 30. Each of sections 28 and 30 is connected to the lower plate 24 by a respectively associated vertical wall. Wall 32 interconnects the lower plate 24 with the upper platform section 28. Wall 34 interconnects the lower plate 24 and the upper platform section 30. The two walls, 32 and 34, extend substantially parallel to one another, and they are spaced sufficiently so that the lower end of a pusher element can move between them. This embodiment employs two of those pusher elements. They are formed by cylindrical bars, one of which, pusher bar 36, is visible in FIG. 1. The lower end of the bar 36 is fixed to two shackles. Shackle 38 is fixed to an endless chain 40, and another shackle 42 is fixed to an endless chain 44. Each of the endless chains, 40 and 44, extends around a respectively associated pair of sprockets. The sprockets are mounted upon shafts which extend between lower plate 24 and the upper platform section 30.

The arrangement of the sprockets is best seen in other figures. However, the end 46 of one of the sprocket shafts is visible in FIG. 1. The lower end of the shaft is connected through a clutch and sprocket assembly 48 to a drive chain 50 which is driven by a drive motor 52. The drive motor is fixed to the sub-frame in that it is bolted to a pair of stand-off elements 56 which extend downwardly from lower plate 24.

The frame arm 20 is fixed. An axle 60 extends vertically through it and the ends of the axle are journalled one in the upper platform section 28 and the other in the lower plate 24. The rotating and discharging unit rotates on the axis of that axle which is the axis 12.

An article retaining wall 62 extends vertically upward from the outer edge of the turntable section 28, and another wall 64 extends vertically upward from the outer edge from the turntable, or platform section 30. That wall 64 extends below the turntable section 30 down to the lower platform 24 to which its lower end is connected. In this embodiment, the walls 62 and 64 are parallel to one another and they are parallel to the walls 32 and 34 of the sub-frame.

A pin 66 is fixed to the sub-frame 24. That pin serves as the point of connection of a crank mechanism that will be described below and whose purpose is to effect rotation of the rotating and discharge apparatus relative to the frame.

When the apparatus is used, an initial stack of papers that usually constitutes about half of a finished stack, is deposited upon the turntable 26. Those papers are arranged so that the folded edge of all of them is at the same side. Then, the assembly 10 is rotated about axis 12 by a crank arm that is connected between pin 66 and the frame. That having been done, another stack of papers is deposited on top of the initial stack. The assumption is made that the structure from which the newspapers are delivered to the apparatus 10 forms stacks of papers such that the folded edge of all the papers in the stack are always in the same direction. That being true, the completed stack that is formed on the turntable 26 will be formed by an initial stack which has the folded edges in one direction, and a subsequent stack which has its folded edges extending in the opposite direction. If the completed stack is to have more than one reversal, that is arranged by simply rotating the structure after each sub-unit of the completed stack is placed atop those sub-units that have previously been deposited on the turntable.

In FIG. 1, the purpose of the light source 16 and the light receiver 18 is to sense when the total stack height exceeds a predetermined level at which the light transmitter and the receiver 18 have been placed. They are placed on a level above the intended height of the sub-units to be rotated and serve to sense the fact that the stack is complete and is to be discharged after the deposit of the next sub-unit.

Discharge of the completed stacks from the turntable is accomplished by a discharge means. That means includes at least one pusher element and a drive unit that moves the pusher element in a way that pushes the stack of newspapers from the turntable. In the broadest sense, all that is required is for some element to engage a stack of papers at one side and then to push the stack until it is removed from the turntable 26.

It is a feature of this invention that the push element be carried with the turntable so that it is rotated with the turntable, notwithstanding that it operates to discharge articles from the turntable at a time when the turntable is not being rotated relative to the frame. In this preferred embodiment, the pusher element extends up through the turntable from a point below the turntable surface. That construction insures that force can be applied over the full height of a stack from the loose uppermost papers to the lower most of the articles in the stack. Because of that construction, it is not necessary for successful operation that the coefficient of friction between adjacent articles in the stack be greater than the coefficient of friction between the lowermost article and the upper surface of the turntable. The manner in which the discharge mechanism operates in this preferred embodiment will be apparent from an examination of FIGS. 2 and 3. There are two push bars. Bar 36 was visible in FIG. 1, but bar 70 was not. It is shackled by upper shackle 72 and lower shackle 74 to the two endless chains 40 and 44, respectively. The chains are driven by motor 52 through the chain 50 which serves to rotate the shaft 46 on which are mounted two drive sprockets, one for each of the endless chains. At the other end of the platform section, the endless chains extend around idler sprockets which are mounted upon a shaft 78. The drive sprocket and idler sprockets are arranged so that the push bars 36 and 70 are separated by the greatest distance in the "home" position they occupy in the figures. That distance is substantially the same as the length of the turntable formed by sections 28 and 30.

When the endless chains are driven by their drive motor 52, the shackles and the drive bars are carried around in a path in a movement that includes a quarter circle around a first sprocket followed by movement through a line that is substantially tangent to both sprockets on one side. Then the push bar moves through a half circle as the shackle is carried around the chains by the other sprocket. Then the push bar returns along a path that is tangent to the two sprockets on the other side and is outside of the stacking platform. Finally, the push bar is returned through another quarter turn to home position. During the course of travel, one push bar moves through the space between wall 32 and wall 34 (wall 32 is visible in FIG. 2, but wall 34 is not visible except in FIG. 1). The other push bar moves outside of the turntable platform. It moves along the outer side of the wall 64. In an application in which the rotating and discharge mechanism is to be used in creating and discharging stacks of newspapers, the area of the turntable platform is made substantially the same as the area of a newspaper. In that case, walls 62 and 64 serve to confine the papers along their longer sides. The push bars 36 and 70 serve to confine papers to the rotatable turntable in the endwise dimension because they are placed adjacent to the short end of the platform. When the push bars are in home position, they are not midway across the width of the platform. Home position for each of the push bars is half-way around the semi-circular path of the chain at the platform ends. Looking downward as in FIG. 3, and assuming that the pusher bars are going to move in a counterclockwise direction, it will be apparent that when the chain begins to rotate, the push bar 36 will first move in a direction tangent to the sprocket 76 and perpendicular to the elongated space between the platform sections 28 and 30. That arrangement permits the motor 52 to begin rotation of the chain and of the push bar without having to exert pushing force on the papers. As the push bar 36 begins its arcuate movement with the chain around the sprocket, it bears against the side of the stack of paper in increasing degree. Only when the push bar has rotated through a ninety degree arc and is ready to commence its movement along the straight path between walls 32 and 34 is the velocity of the stack of papers equal to the velocity of the push bar. That arrangement imposes a minimum requirement for starting torque on the drive motor 52. Moreover, it results in the gradual application of force to the stack of papers and the gradual acceleration of those papers. Thus it is that the initial motion that is employed to push the stack from the table includes little or no parasitic travel.

The other bar is moved out of the way of the stack so that it is free to move from the table. In this preferred form of the invention, the bars interchange position with each discharge cycle. Motor 52 is capable of reverse operation so that the papers can be discharged in either direction from the turntable and it is not uncommon in practice to discharge succeeding stacks from opposite sides of the turntable.

Being offset from the centerline of the turntable ends does not reduce the effectiveness of the push bars in the task of confining stack articles to the stacking position on the turntable. That is because both pusher rods are displaced at the same side of the center line between guides 62 and 64.

Figure 3:
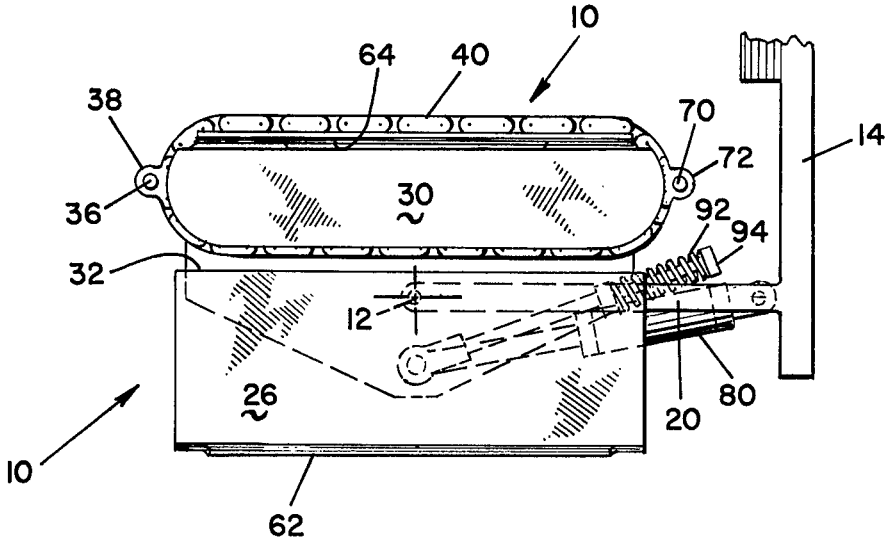
FIG. 3 is a top view of the article rotating and discharge apparatus.
Figure 4:
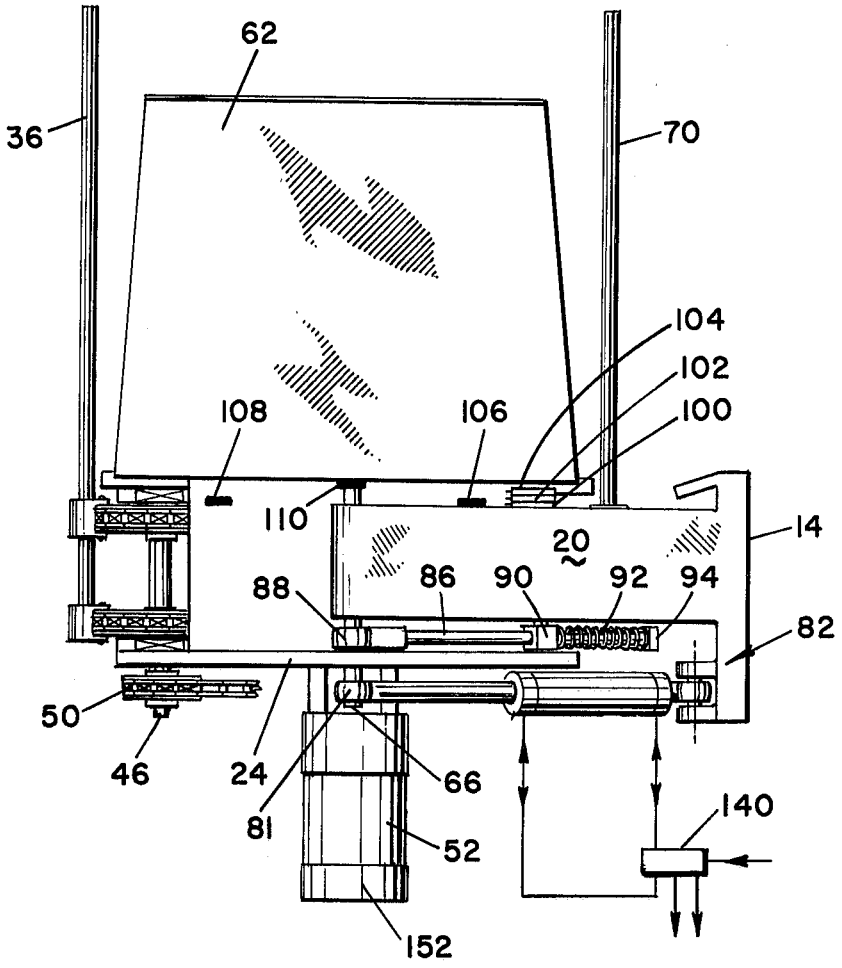
FIG. 4 is a view in elevation of the opposite side of the apparatus.
Figure 6:
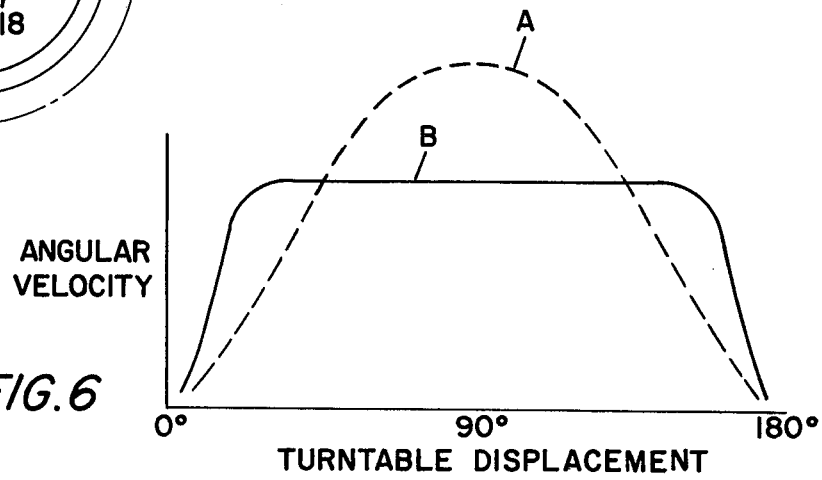
FIG. 6 is a graph that illustrates operation of the apparatus.

It will be apparent from a comparison of FIGS. 1, 3, and 4 that the axis of rotation of motor 52 is coincident with the axis of rotation 12 of the assembly 10. Rotation of the whole assembly is accomplished with a crank mechanism. The crank includes crank pin 66 and a crank actuating arm 80. In this embodiment, the latter is a piston and cylinder combination that operates from a fluid source which may comprise air or liquid. The crank pin 66 is fixed to the assembly 10. It is fixed to the lower plate 24 of that assembly at a point that is spaced from the rotation axis 12. One end of the crank arm 80 is connected to the pin 66 at the lower side of plate 24. The connection is a pivotal one made with a bearing 81. The other end of arm 80 has pivotal connection by a bearing to the frame 14. That structure is generally designated 82 in the drawing. Since the arm 80 is formed by a cylinder and piston assembly, its length can be changed. When the arm is shortened, the reversing and discharge assembly begins to rotate around axis 12. The structure is arranged so that in the beginning and final positions of the assembly 10, a line drawn from the axis of pin 66 to the axis of rotation 12, and then to the axis of rotation of the other end of the arm at structure 82, forms a right angle. If the structure initially occupies the position relative to the frame that it is shown to occupy in FIG. 3, and if the piston and cylinder assembly is operated to reduce the length of the crank arm 80, pin 66 will be drawn toward assembly 82. Force is applied to continue that rotation through 90°. At that time, the pivot axis 12, the pivot axis of pin 66, and the pivot axis at assembly 82 will be in line. The assembly 10 will have acquired sufficient momentum to carry it beyond that dead center condition whereupon the length of the crank arm 80 is lengthened by operation of the piston and cylinder assembly until the reversing and discharging mechanism 10 occupies the position 180° from the position it occupies in FIG. 3. Curve A in FIG. 6 is a graph of the relationship of the angular velocity of the structure 10 plotted against its angular displacement that would result in a typical case in which the crank arm 80 was formed by an air cylinder and piston assembly controlled by a valve, such as valve 140 which applies fluid first to shorten arm 80 and then to lengthen it.

The angular velocity in the mid-region of the travel of the structure 10 can be reduced quite easily, and it is reduced in the preferred embodiment of the invention by the addition of a spring force arranged to oppose the inertial forces developed by the rotating assembly. This makes the angular velocity substantially uniform as shown by curve B in FIG. 6.

Turning to FIG. 4, the rod 86 has pivotal connection at one end 88 to the crank pin 66 just above the lower sub-frame plate 24. The other end of that rod 86 extends through a slide 90 and through a coiled spring 92 to enlarged end 94. The spring 92 is trapped between the enlarged end 94 and the slide member 90. The latter has pivotal connection to the underside of arm 20 of the frame 14. When the rotatable turntable and discharge assembly 10 occupies the position shown in FIG. 3 and the reversed position, spring 92 is compressed. When the rotatable turntable and discharge assembly is midway in its travel and occupies a position in which the crank pin 66 is between and aligned with axis 12 and the slide member 90, the spring 92 is relaxed, or nearly so, because arm 86 has been pushed through the slide 90 such that the enlarged end 94 is at a maximum distance from the slide member 90.

Figure 2:
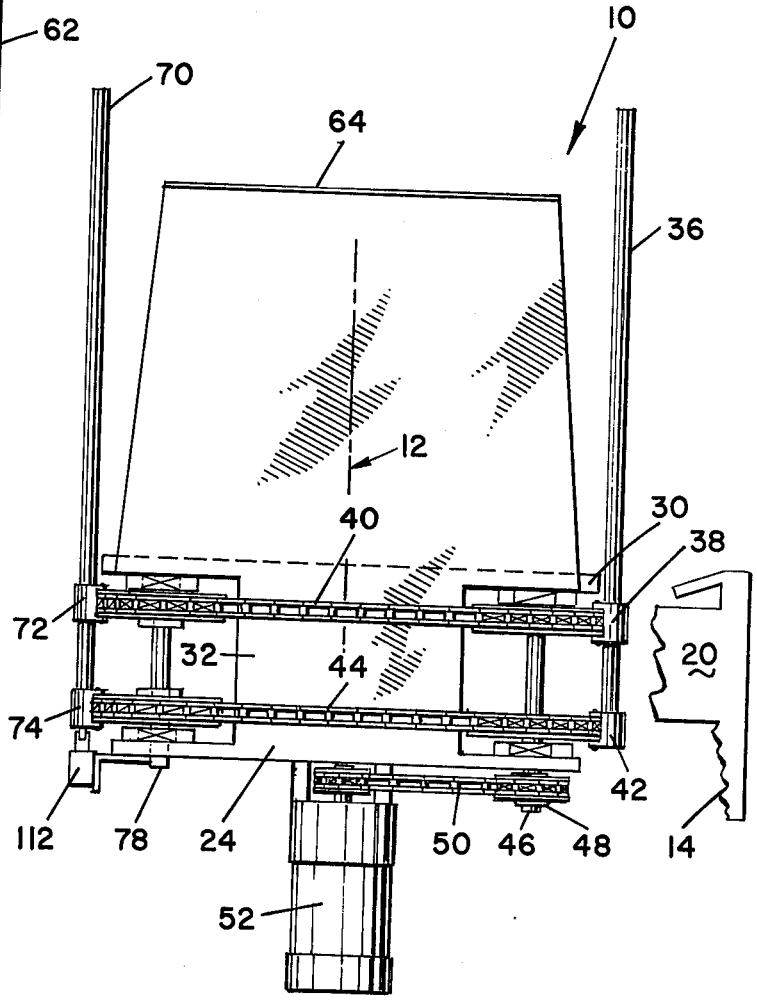
FIG. 2 is a view in side elevation of the article rotating and discharging apparatus of FIG. 1 together with a fragment of a frame on which it is mounted.

Mid-way along the upper edge of arm 20 in FIG. 4 there are three switches designated 100, 102, and 104, respectively. The actuators of those switches are engaged in rotation of the turntable by strikers 106, 108, and 110, respectively, that are seen to be carried by the sub-frame 24. In FIG. 2, a switch 112 is visible at the lower left-hand corner. Its actuator is operated when struck by one or the other of the shackles that bind the lower end of push rods 36 and 70 to the drive chains 40 and 44. While not visible in any of the drawings, other than the circuit diagram of FIG. 5, because it is obscured by other components, the unit includes a switch 114 whose actuator is operated by elements on a collar 116 which is fixed to the shaft 46 by which the endless chains are driven. That collar includes two switch operators 118 and 119 formed as protrusions on diametric points from the collars. That structure is shown schematically at the lower left in FIG. 5. The switch actuators 106, 108, and 110 are shown schematically in the mid-regions of FIG. 5. The respective switches that they operate are indicated by dashed lines that interconnect those switches with the operators respectively.

Operation of the turntable is related to operation of the mechanism by which papers are deposited on the turntable through switches that are operated by switch actuators 120 and 122. Those actuators may be seen in FIG. 5 and in FIG. 1 above the turntable. They actuate switches to indicate whether or not that paper depositing mechanism 500 is in its upper, paper catching and storage position, or in its lower position at which it deposits paper on the turntable.

The case of the discharge motor 52 houses a brake 152 for the motor at its lower end. And, finally, the fluid supply and control system by which the air or hydraulic system 80 is actuated, is diagrammed in FIG. 4. That diagram includes an electrically operated valve 140 which is actuated to cause a fluid flow to the cylinder 80 in either direction or to stop flow.

Figure 5:
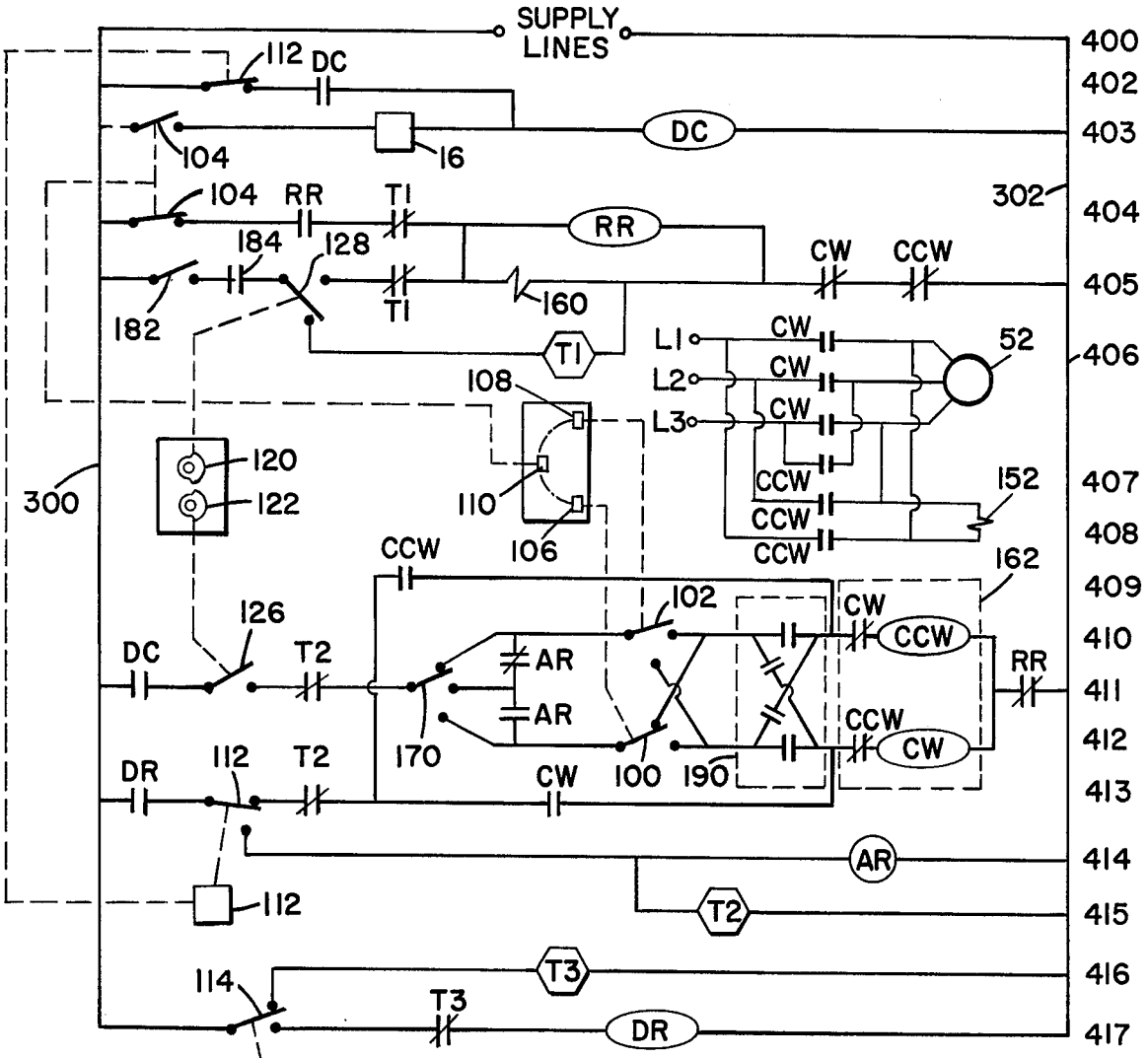
FIG. 5 is a diagram of the electrical control circuit for the apparatus depicted in FIGS. 1 through 4.
Figure 5:
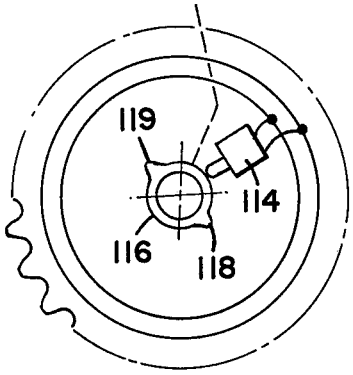

The function of the electrical circuitry and apparatus that is diagrammed in FIG. 5 is to operate the fluid control valve 140 and to operate the discharge drive motor 52 and its brake 152. The circuitry by which that is done is conventional. It is diagrammed here in FIG. 5 to illustrate that the system lends itself to the inclusion of a variety of protective features. It was mentioned earlier that synchronous operation of the turntable rotating mechanism and the discharge mechanism was not feasible. The fact that newspapers have different size from day to day, and that they may not be delivered to the stacking position in a steady stream means that the cycle times may change from day to day and from moment to moment within the day. Moreover, the unit described here will discharge papers to a conveyor, or other place, from which each stack must be moved to make room for the next stack that is discharged. If stacks of papers become backed up on that conveyor system, it may be necessary to prevent the discharge mechanism from operating or, alternatively, to cause it to discharge the papers onto a conveyor or into a storage area at the opposite side. The provision of protective apparatus and procedures to prevent harm to the machinery and to the machine operators and paper handlers may introduce other possibilities of harm that require the addition of even more protective apparatus. For example, it was described earlier that the drive mechanism for the discharge means includes a slip clutch. If the discharge mechanism is opposed by a force sufficient to permit slipping of the clutch, the discharge mechanism will not operate to discharge the stack. Nonetheless, the mechanism will attempt to do that. That situation introduces a time lag during which papers of the next stack are accumulating above. The system that is described here includes a means for limiting the time period over which the mechanism will attempt to discharge papers against an opposing force. It also includes a means for reversing the discharge direction if opposing forces have prevented the discharge in the direction of the original attempt to discharge. If the discharge is prevented altogether, the system includes a means for shutting down operation. If the mechanism that deposits papers on the stack has operated to increase the stack height above a level that the structures can accommodate, the unit will stop.

These several safety features, and some others, are incorporated into the system by inclusion of the position and height sensors previously described. Switches 100, 102, and 104 sense the rotational position of the turntable. Switch 112 senses the position of the push bar. Switch 114 of FIG. 5 senses the existence of excessive forces in opposition to discharge. Sensor 16 senses when stack height is excessive. Switches 126 and 128 sense the operatonal state of the mechanism that deposits papers on the stacking platform through the medium of operating cams or switch actuators 122 and 120, respectively.

How protection is provided can be understood by an examination of the circuit arrangement of FIG. 5. To facilitate understanding, FIG. 5 has been drawn using some of the conventions employed in the electrical control industries. The diagram itself is arranged so that the components, or most of them, fall on horizontally drawn circuit lines, and those lines are identified by numerals placed opposite them on the right side of the page. Contactors whose electrical actuators include time delay circuits are represented by hexagons. The actuator of conventional electrically operated contactors is represented by ovals. The electrical actuator of a stepping relay is represented by a circle. Those components which are special, or for which there is no identifying shape, are represented in rectangular boxes.

The power lines 300 and 302 are connected to the supply mains at line 400 in FIG. 5. The discharge motor 52 and its brake 152 are energized from a three-phase line L1, L2 and L3 in the circuit as shown in the center right in FIG. 5. The brake 152 is energized when its winding is energized in parallel with either the reverse connection or the forward connection of the motor 52. The CW and CCW contacts in that circuit respond to the CW and CCW contactor solenoids at lines 412 and 410, respectively.

The solenoid that operates the fluid control valve 140 is numbered 160 and it can be found on line 405 of FIG. 5. To complete the description of the components of the system, the motor starter system for discharge motor 52 is designated 162. It includes a counterclockwise contact actuator represented by the oval and the symbol CCW on line 410 of the diagram. The motor starter also includes a clockwise rotation actuator represented by an oval and the symbol CW on line 412 of FIG. 5. The contactor CCW includes normally closed contacts on line 405 and line 412 and it includes normally open contacts on line 407 and on line 409. A contactor CW includes normally closed contacts on line 405 and line 410, and it includes normally open contacts on lines 406 and 413.

The circuit includes a manual selector switch 170 which can be placed in any of three positions. In its upper position, the motor 52 will be energized for one direction of rotation so that papers are always discharged to the same side. When the switch is moved to the lowermost position, the situation is reversed and the mechanism will discharge papers only to the other side. When the switch is placed in an intermediate position, then the discharge mechanism works alternately to discharge papers first to one side and then to the other. That is accomplished through the medium of a stepping relay whose actuator appears at line 414, whose normally closed contacts appear between lines 410 and 411, and whose normally open contacts appear between lines 411 and 412. The command to operate the discharge motor is given by the height switch 16 on line 403 of FIG. 5. Discharge commands are given through the medium of normally open contacts on line 411 which are operated by actuator DC on line 403. That contactor includes another set of contacts on line 402.

The commands to rotate the turntable are given by the actuator cam 120 of the apparatus that delivers papers to the turntable. That cam operates switch 128 which is found on line 405 of the diagram. When that switch is closed, the fluid valve operator 160 is energized. It is energized through a manual NO-ROTATION-DISCHARGE ONLY switch 182 and a contactor 184 which forms part of a protective system associated with other apparatus in the production line.

The rotate relay, whose actuator RR appears on line 404 together with a normally open contact on that line and a normally closed contact on line 411, acts to hold the rotation control valve 140 in rotation position until position sensor 110 actuates the switch 104 to indicate that the table has been rotated to the 90° point.

Block 190 at lines 410, 411, and 412 of the diagram represents a set of reversing contacts that are controlled by an actuator DR shown in the oval symbol at line 417. That DR actuator is energized through switch 114 in the line 417. A normally open contact of the DR relay appears on line 413 to stop the discharge motor allowing block 190 to reverse the motor rotaton.

There are three timers in the system. Timer T1 on line 406 controls normally closed contacts on lines 404 and 405 to control operaton of the rotate relay RR and the fluid valve operator 160. Operation of the timer T1 is under the control of switch 128 which reponds to the position of cam 120 as previously described.

Timer T2 on line 415 controls operation of normally closed contacts in the lines that supply power to the motor starter 162. Operaton of timer T2 is controlled by the lower section of switch 112 which appears at line 413. That switch is the one that appears in the lower left corner of FIG. 2 and is operated by the shackles that connect the pusher rods to their drive chains.

The third timer is found on line 416 and it operates a normally closed contact in line 417 in series with the actuator of the discharge reverse contactor DR. The third timer is designated T3.

The system operates in the following manner. Switches 100, 102, and 104 sense the position of the turntable and determine the direction of rotation of the discharge motor. They work in combination with the manually operated switch 170 to arrange energization of the motor starter 162 in a way that will cause the motor, when energized, to turn in a proper direction. If the switch 170 has been moved to its mid-position, the ratchet relay AR operates with each discharge operation through switch 112 at line 413 to make the CCW and the CW relays operate alternately.

Switch 112 also controls the timer T2 to limit the duration over which discharge forces are expected and it terminates the discharge command DC at line 402 and at line 403. When the discharge command relay is energized, discharge is permitted to occur when it is initiated by switch 126. That switch is operated by cam 122 which may be found at line 407 of FIG. 5 and in the upper portion of FIG. 1.

The discharge command is initiated by the sensor 16 which detects stack heights greater than the vertical distance between the turntable platform and the position of the sensor 16. The vertical position of sensor 16 is adjustable and sensing occurs at the mid-point in rotation. The rotation relay RR is energized when switch 128 is operated by cam 120 which appears at line 407 in FIG. 5 and in the upper portion of FIG. 1. The relay RR holds the valve 140 energized until the switch striker 110 operates switches 104 on line 404 at the ninety degree position of the turntable. The switch 128 also controls timer T1 to limit the duration over which rotation force is exerted.

If the discharge motion is blocked in the selected direction, the clutch 48 slips, as previously described, allowing relative rotation between the discharge mechanism drive shaft and its drive chain. The swtich operators 118 and 119 operate switch 114 to energize the DR relay and reverse rotation of the discharge motor. Timer T3 limits the duration that the DR relay is energized.

Although I have shown and described certain specific embodiments of my invention, I am fully aware that many modifications thereof are possible. My invention, therefor, is not to be restricted except insofar as is necessitated by the prior art.

I claim:

1. In an article stacker, in combination:

a turntable;

means for depositing articles on said turntable such that they form an initial stack of articles;

means for rotating said turntable through a half circle;

means for depositing a further quantity of articles such that they form an extension of said initial stack; and cooperate therewith to define an extended stack;

pushing means extending the full height of the extended stack of articles for pushing same from said turntable; and said pushing means being carried by said turntable and being rotatable therewith during formation of the extended stack and being movable relative thereto for pushing the extended stack therefrom.

2. The invention defined in claim 1 which further comprises means in the form of four elements initially disposed one on each of four sides of the area on said turntable at which articles are deposited for confining articles deposited on said area to a vertical stack;

said pushing means comprising one of said elements and means for moving said one element on a line between two others of said elements toward the position initially occupied by an opposed one of said elements while moving said opposed element from its initial position toward the position initially occupied by said one element.

3. The invention defined in claim 2 in which said two others of said elements are fixed to the turntable and are immovable in relation to the turntable.

4. The invention defined in claim 1 in which said turntable is formed by a pair of platforms spaced from one another to define a passage for movement of said pushing means therethrough from one side to the other of said turntable.

5. Apparatus for reversing the position of articles and discharging them from a work station comprising:

turntable means for receiving, at a work station, articles whose position is to be reversed;

rotating means for rotating the turntable means;

discharge means for discharging said articles from said work station independently of rotation of said turntable means;

said discharge means being interconnected with said turntable means and rotatable therewith; and said discharge means being elongated for engaging the full height of articles stacked on said turntable means.

6. The invention defined in claim 5 which further comprises a frame and a rotatable assembly mounted for rotation relative to said frame on a rotation axis:

said assembly comprising said turntable means and said discharge means;

said discharge means comprising a push element moveable in a plane that is parallel to the axis of rotation of said assembly, a portion of said plane extending through said work station;

said turntable comprising two platform sections disposed in a second plane perpendicular to the axis of rotation of said assembly and perpendicular to said plane of movement of said push element;

said platform sections being disposed on opposite sides, respectively, of the plane of movement of said push element whereby the push element may be moved through the turntable means between the platform sections in discharging articles from said turntable means.

7. The invention defined in claim 6 which further comprises means for moving said push element, said means for moving said push element serving to move, guide and orient said element and being moveable between the said platform sections and below the uppermost horizontal surfaces of said sections.

8. The invention defined in claim 5 which further comprises a frame and an assembly mounted for rotation on said frame;

said assembly comprising discharge means and said turntable;

the discharge means comprising a pusher element;

the turntable being divided into sections spaced one from another in a degree sufficient to permit passage between said sections, from one side of the turntable to the other, of said pusher element.

9. The invention defined in claim 8 in which said pusher element is fixed to an endless drive member looped around sprockets rotatable about axes extending parallel to the rotational axis of said turntable, drive means for driving said endless drive member to locate said pusher element at a home position in which the point at which the pusher element is fixed to the endless drive member lies substantially in the plane containing the axes of said sprockets whereby initial motion of said pusher element follows an arcuate path beginning in a direction substantially perpendicular to the direction in which articles are pushed from said platform.

10. Apparatus for reversing the position of articles and discharging them from a work station comprising: a frame, an assembly mounted for rotation on said frame, said assembly including a turntable interconnected with a pusher element, rotating means for rotating said turntable and pusher element, said turntable being divided into sections spaced from one another for providing passage therebetween of said pusher element from one side to the other of said turntable, a pair of sprockets rotatably mounted on said assembly for rotation about sprocket axes parallel to the rotational axis of said assembly, an endless drive member extending around said sprockets, said pusher element being fixed to said endless drive member, and drive means for driving said endless drive member for moving said pusher element through said passage between said turntable sections.

11. The invention defined in claim 10 including at least two pusher elements mounted at spaced points on said endless drive member for movement in opposite directions along paths, one such path being substantially tangent to said sprockets at one side thereof and through said passage between said turntable sections and around half the periphery of said sprockets engaged by said endless drive members, the other said path being substantially tangent to said sprockets on the other side thereof and around the other half the periphery of said sprockets.

12. Apparatus for reversing the position of articles and discharging them from a work station comprising: a frame, an assembly mounted for rotation on said frame, said assembly including a turntable interconnected with a pusher element, said turntable being divided into sections spaced from one another for providing passage therebetween of said pusher element from one side to the other of said turntable, an endless drive member, said pusher element being fixed to said endless drive member, drive means for driving said endless drive member for moving said pusher element through said passage, rotating means for rotating said turntable and pusher element, said rotating means including a crank arm defined by a cylinder and piston having pivotal connection to said frame and to said assembly at points separated from the axis of rotation of said assembly, said rotating means further including a resilient element connected between said frame and said assembly for urging said assembly to rotate during all or part of the first half of its rotation and for opposing rotation during a like part of the second half of its rotation.

13. Apparatus for reversing the position of articles and discharging them from a work station comprising: turntable means for receiving, at a work station, articles whose position is to be reversed, rotating means for rotating the turntable means, discharge means for discharging articles from said work station in either of two opposite directions by exerting forces on the articles in one or the other of such directions, said discharge means being interconnected with said turntable means for rotation therewith by said rotating means, and means for sensing the force exerted upon articles being discharged from said work station, and, in the event the force exceeds a predetermined value, reversing the direction of force applied to said articles.

14. A turntable rotatable about a vertical axis and carrying discharge means for discharging articles from said turntable, said discharge means being rotatable with said turntable and being movable relative to said turntable for discharging articles therefrom, drive means mounted on said turntable for driving said discharge means, and said drive means including a drive motor suspended beneath said turntable substantially coincidental with said axis about which said turntable rotates.

15. The turntable as defined in claim 14 wherein said drive means includes spaced-apart sprockets mounted for rotation beneath said turntable on axes extending parallel to said axis about which said turntable rotates, and endless drive member extending around said sprockets, said discharge means comprising a vertically elongated pusher element fixed to said endless drive member, and said drive motor being drivingly connected with one of said sprockets.

16. The turntable as defined in claim 15 wherein said turntable has a passage completely therethrough from one side to the other thereof for movement of said pusher element therethrough in a pushing direction, and said pusher element being movable outside of the periphery of said turntable in a return direction.

17. A turntable rotatable substantially 180°, power rotating means for rotating said turntable, and resilient means for urging said turntable to rotate during all or part of the first half of its rotation and for opposing rotation during a like part of the second half of its rotation.

18. The turntable as defined in claim 17 wherein said power rotating means comprises a fluid cylinder.

19. The turntable as defined in claim 18 wherein said turntable is rotatably mounted to a frame on a substantially vertical turntable axis, said resilient means and fluid cylinder being connected to said turntable at turntable pivot connections and to said frame at frame pivot connections, said turntable axis, turntable pivot connections and frame pivot connections lying substantially in a common plane when said turntable is approximately half way through its rotation.

20. A turntable having a support platform and being rotatable about a substantially vertical axis, pusher means for pushing articles from said turntable, said pusher means being interconnected with said turntable for rotation therewith and being movable relative to said turntable from one end to the other of said platform within the periphery thereof for pushing articles therefrom, and said pusher means being returnable from said other end to said one end by moving outside the periphery of said platform.

21. The turntable as defined in claim 20 wherein said platform is in a pair of spaced-apart platform sections defining a passage therebetween, said pusher means being vertically elongated and extending upwardly through said passage during movement thereof from said one end to the other of said platform within the periphery thereof.

22. The turntable as defined in claim 20 including drive means for driving said pusher means, said drive means being mounted on said turntable beneath said platform and including an endless drive members, said pusher means being fixed to said endless drive member.

23. A turntable having a support platform and being rotatable about a substantially vertical axis, elongated spaced-apart substantially vertical fixed guide and support elements on opposite sides of said platform, elongated spaced-apart substantially vertical movable guide and support elements located at opposite ends of said platform, said guide and support elements being rotatable with said platform, said movable guide and support elements being movable relative to said platform for pushing articles therefrom, said movable elements being movable relative to said platform by movement of one such element between said fixed elements in a direction toward the other such element from one end to the other of said platform while the other such element moves in a direction back toward the original position of the one such element by moving outside the periphery of said platform, said guide and support elements serving to guide articles dropped toward said platform and to support the articles on said platform during rotation of said turntable, and said movable guide and support elements also serving as pusher elements for pushing the articles from said platform.

24. The turntable as defined in claim 23 wherein said platform is in a pair of spaced-apart platform sections defining a passage therebetween, and said movable elements being movable through said passage while pushing articles from said platform.

25. The turntable as defined in claim 23 wherein said movable elements are mounted on a drive mechanism mounted on said turntable below said platform.

26. The turntable as defined in claim 23 wherein said movable elements are movable in either of opposite directions for pushing articles from either end of said platform.

* * * * *